US011156012B2

(12) United States Patent
Graham

(10) Patent No.: US 11,156,012 B2
(45) **Date of Patent: *Oct. 26, 2021**

(54) CONVERTIBLE HAMMOCK-SHADE TENT

(71) Applicant: Michael J. Graham, Scottsdale, AZ (US)

(72) Inventor: Michael J. Graham, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/843,584

(22) Filed: Apr. 8, 2020

(65) Prior Publication Data

US 2020/0232246 A1 Jul. 23, 2020

Related U.S. Application Data

(63) Continuation of application No. 16/196,554, filed on Nov. 20, 2018, now Pat. No. 10,655,357.

(51) Int. Cl.
*E04H 15/30* (2006.01)
*E04H 15/64* (2006.01)
(Continued)

(52) U.S. Cl.
CPC ..... *E04H 15/30* (2013.01); *A45F 3/22* (2013.01); *A45F 3/24* (2013.01); *A45F 4/00* (2013.01);
(Continued)

(58) Field of Classification Search
CPC ..... E04H 15/003; E04H 15/30
See application file for complete search history.

(56) References Cited

U.S. PATENT DOCUMENTS 2,134,879 A * 11/1938 Levy ..... E04H 15/003 135/87
2,554,688 A * 5/1951 Vollweiler ..... A45F 4/04 135/95
(Continued)

FOREIGN PATENT DOCUMENTS

FR 1066439 A * 6/1954 ..... E04H 15/003
WO WO-2017177354 A1 * 10/2017 ..... A45F 3/22

*Primary Examiner* — David R Dunn
*Assistant Examiner* — Danielle Jackson
(74) *Attorney, Agent, or Firm* — Weiss & Moy, P.C.; Jeffrey D. Moy

(57) ABSTRACT

A convertible hammock-shade tent configurable as a shade tent and a hammock comprising (I) A plurality of tiers comprising a first tier and a second tier wherein (a) the second tier has a plurality of perimeter sleeves and (b) each tier has positioned thereon a plurality of apertures; (II) A plurality of vertically adjustable telescoping posts comprising a first, second, third, and fourth post wherein each (a) is attachable to the first and second tiers by an attachment device and (b) comprises a plurality of post segments, each with an upper and a lower end, comprised of at least a first post segment with a lower end configured for securing the post to the ground and attaching the post to the first tier and a second post segment positioned above the first post segment and configured for attaching the post to the second tier; (III) Wherein the tiers and posts can be configured for use as a shade tent wherein the first tier comprises the shade tent floor and the second tier comprises the shade tent canopy positioned above the first tier and wherein (a) a bendable member is inserted into at least one second tier perimeter sleeve, and (b) a second tier support system is positioned below and proximal the second tier and comprises a first and a second cross brace, with each cross brace having a first and a second end, and a plurality of cross brace attachment members, wherein each cross brace end is
(Continued)

attached to a cross brace attachment member attached to a second post segment of a post; and (IV) Wherein one tier can be configured for use as a hammock, wherein (a) the tier comprises a hammock panel having a panel first end and a panel second end wherein the panel first end is attached to a first erecting structure and the panel second end is attached to a second erecting structure, and (b) one or more panel perimeter apertures and one or more panel perimeter sleeves is proximal each panel end.

7 Claims, 7 Drawing Sheets

(51) Int. Cl.

| | |
|---|---|
| ***E04H 15/40*** | (2006.01) |
| ***A45F 4/00*** | (2006.01) |
| ***A45F 3/24*** | (2006.01) |
| ***A45F 3/22*** | (2006.01) |
| ***E04H 15/04*** | (2006.01) |
| ***E04H 15/58*** | (2006.01) |
| *E04H 15/46* | (2006.01) |
| *E04H 15/56* | (2006.01) |
| *E04H 12/22* | (2006.01) |
| *E04H 15/00* | (2006.01) |

(52) U.S. Cl.
CPC ..... *E04H 15/04* (2013.01); *E04H 15/40* (2013.01); *E04H 15/58* (2013.01); *E04H 15/64* (2013.01); *E04H 12/2223* (2013.01); *E04H 15/005* (2013.01); *E04H 15/46* (2013.01); *E04H 15/56* (2013.01)

(56) References Cited

U.S. PATENT DOCUMENTS

| | | | | | |
|---|---|---|---|---|---|
| 2,777,454 | A * | 1/1957 | Kramer | E04H 15/003 | 135/87 |
| 2,928,405 | A * | 3/1960 | Lawson | E04H 15/003 | 135/95 |
| 3,282,274 | A * | 11/1966 | Scott | E04H 15/30 | 135/142 |
| 3,404,696 | A * | 10/1968 | De Souza Filho | E04H 15/003 | 135/91 |
| 3,590,864 | A * | 7/1971 | Vechesloff | A45F 4/02 | 135/95 |
| 4,239,135 | A * | 12/1980 | Armstrong | A45F 4/04 | 224/154 |
| 4,471,794 | A * | 9/1984 | Kirkham, Jr. | E04H 15/30 | 135/95 |
| 4,750,508 | A * | 6/1988 | Tatoian | E04H 15/003 | 135/118 |
| 4,862,906 | A * | 9/1989 | Jordon | A45F 3/22 | 135/95 |
| 5,088,514 | A * | 2/1992 | House | E04H 15/58 | 135/139 |
| 5,150,485 | A * | 9/1992 | Maguire | A47G 9/062 | 5/417 |
| 5,415,194 | A * | 5/1995 | Kaye | E04H 15/003 | 135/115 |
| 5,769,106 | A * | 6/1998 | Achuff | A41D 15/04 | 135/95 |
| 9,788,658 | B2 * | 10/2017 | King-O'Connor | E04H 15/02 | |
| 10,149,530 | B1 * | 12/2018 | Grayson | E04H 15/30 | |
| 10,655,357 | B1 * | 5/2020 | Graham | E04H 15/64 | |
| 10,837,195 | B2 * | 11/2020 | Wiseman | E04H 15/54 | |
| 2005/0051203 | A1 * | 3/2005 | McCully | A45F 4/00 | 135/87 |
| 2008/0283105 | A1 * | 11/2008 | DuBose, III | A45B 23/00 | 135/96 |
| 2017/0224092 | A1 * | 8/2017 | Smith, Jr. | A45F 3/22 | |

* cited by examiner

CONVERTIBLE HAMMOCK-SHADE TENT

FIELD OF THE INVENTION

The present invention relates to a shade tent and, more specifically, to a shade tent which is convertible to a hammock and which is foldable for ease of storage and carrying, wherein a pair of tiers provide ground cover and sun shelter, telescoping posts are used to mount and secure the tiers, and wherein the tiers can be used as a hammock.

BACKGROUND OF THE INVENTION

Shade tents, are well known in the art. These shade tents, which are commonly used in the outdoors to provide shade from the sun and are commonplace on beaches, are typically comprised of a shade covering and a plurality of stakes which are pushed into the ground surface to secure the shade covering to the ground. Shade tents typically perform better in windy conditions since beach and other large umbrellas designed for use in the sun as a sun shelter are prone to being uplifted and tipping over and/or flying away in high-wind conditions, often with devastating consequences such as causing injury to persons or property.

Although shade tents have superior wind performance compared to sun umbrellas, the covering provided by shade tents generally cannot be easily angularly adjusted or angled to accommodate changes in the angle at which rays from the sun are hitting the shade. The angle at which the rays from the sun hit the Earth determines the intensity of the sunlight. Without an ability to be angled to account for the variation of angle of incidence during the day, there are times during the day when the shading surface of the shade tent typically provides good shade and coverage from the sun but other times, such as the late afternoon to early evening, when the shading surface provides little, if any, shade from the sun due to the angle of incidence during such times.

As indicated earlier, a common place where sun tents are used is at the beach. Most beachgoers have to carry, often from vehicles or homes located not at or near the beach, many different articles such as beach tents, coolers, food, chairs, large bulky beach towels, and beach blankets or other items that can be placed on top of the beach sand to provide for relatively sand-free ground cover, as well as accompany small children who often have to be walked or carried by an adult. As such, most beachgoers only want to bring with them items that they can easily be carried, often sacrificing articles which many beachgoers would like to take to the beach but practically cannot.

Most beachgoers, faced with the need to carry many bulky items, prefer toting items to the beach that come in, convert to, or are placeable in a storage device designed to be portable and carried by a person, such as a carry tote. Beach-related products that can be collapsed, folded, or compressed so as to be accommodated in a portable storage device are generally greatly preferred by beachgoers. However, many beach-related items, such as hammocks and complementary structures, shade tents or umbrellas, and beach towels, are inherently bulky and cannot be easily wheeled, in a wagon or other wheeled structure, onto a beach. In addition, most beach-related items, like items in general, have one primary or singular configured use. For example, most shade tents only can be configured as or include structures to provide a shade tent configuration and not also serve as, inter alia, or provide beach ground cover. Likewise, most beach ground cover items, such as beach blankets, only can be configured as or include structures to provide a ground cover configuration and not also serve as a shade tent or provide shading of any kind.

Therefore, it would be desirable to provide a system and method that overcomes the above.

SUMMARY OF THE INVENTION

A first aspect of the invention comprises a convertible hammock-shade tent configurable as a shade tent and a hammock comprising (I) a plurality of tiers comprising a first tier and a second tier wherein (a) the second tier has a plurality of perimeter sleeves and (b) each tier has positioned thereon a plurality of apertures; (II) a plurality of vertically adjustable telescoping posts comprising a first, second, third, and fourth post wherein each (a) is attachable to the first and second tiers by an attachment device and (b) comprises a plurality of post segments, each with an upper and a lower end, comprised of at least a first post segment with a lower end configured for securing the post to the ground and attaching the post to the first tier and a second post segment positioned above the first post segment and configured for attaching the post to the second tier; (III) wherein the tiers and posts can be configured for use as a shade tent wherein the first tier comprises the shade tent floor and the second tier comprises the shade tent canopy positioned above the first tier and wherein (a) a bendable member is inserted into at least one second tier perimeter sleeve, and (b) a second tier support system is positioned below and proximal the second tier and comprises a first and a second cross brace, with each cross brace having a first and a second end, and a plurality of cross brace attachment members, wherein each cross brace end is attached to a cross brace attachment member attached to a second post segment of a post; and (IV) wherein one tier can be configured for use as a hammock, wherein (a) the tier comprises a hammock panel having a panel first end and a panel second end wherein the panel first end is attached to a first erecting structure and the panel second end is attached to a second erecting structure, and (b) one or more panel perimeter apertures and one or more panel perimeter sleeves is proximal each panel end.

A second aspect of the invention comprises a convertible hammock-shade tent configurable as a shade tent and a hammock comprising (I) a plurality of tiers comprising a first tier and a second tier wherein (a) the second tier has a plurality of perimeter sleeves and (b) each tier has positioned thereon a plurality of apertures; (II) a plurality of vertically adjustable telescoping posts comprising a first, second, third, and fourth post wherein each (a) is attachable to the first and second tiers by an attachment device and (b) comprises a plurality of post segments, each with an upper and a lower end, comprised of at least a first post segment with a lower end configured for securing the post to the ground and attaching the post to the first tier and a second post segment positioned above the first post segment and configured for attaching the post to the second tier, and a center post segment between the first and second post segments; (III) wherein the tiers and posts can be configured for use as a shade tent wherein the first tier comprises the shade tent floor and the second tier comprises the shade tent canopy positioned above the first tier and wherein (a) a bendable member is inserted into at least one second tier perimeter sleeve, and (b) a second tier support system is positioned below and proximal the second tier and comprises a first and a second cross brace, with each cross brace having a first and a second end, and a plurality of cross brace attachment members, wherein each cross brace end is attached to a cross brace attachment member attached to a second post segment of a post; and (IV) wherein one tier can be configured for use as a hammock, wherein (a) the tier comprises a hammock panel having a panel first end and a panel second end wherein the panel first end is attached to a first erecting structure and the panel second end is attached to a second erecting structure, and (b) one or more panel perimeter apertures and one or more panel perimeter sleeves is proximal each panel end.

A third aspect of the invention comprises a convertible hammock-shade tent configurable as a shade tent and a hammock comprising (I) A plurality of tiers comprising a first tier and a second tier wherein (a) the second tier has a plurality of perimeter sleeves and (b) each tier has positioned thereon a plurality of apertures; (II) a plurality of vertically adjustable telescoping posts comprising a first, second, third, and fourth post wherein each (a) is attachable to the first and second tiers by an attachment device and (b) comprises a plurality of post segments, each with an upper and a lower end, comprised of at least a first post segment with a lower end configured for securing the post to the ground and attaching the post to the first tier and a second post segment positioned above the first post segment and configured for attaching the post to the second tier; (III) wherein each tier is a quadrilateral and each telescoping post is positioned at a corner of each tier, (IV) wherein the tiers and posts can be configured for use as a shade tent wherein the first tier comprises the shade tent floor and the second tier comprises the shade tent canopy positioned above the first tier and wherein (a) a bendable member is inserted into at least one second tier perimeter sleeve, and (b) a second tier support system is positioned below and proximal the second tier and comprises a first and a second cross brace, with each cross brace having a first and a second end, and a plurality of cross brace attachment members, wherein each cross brace end is attached to a cross brace attachment member attached to a second post segment of a post; and (V) wherein one tier can be configured for use as a hammock, wherein (a) the tier comprises a hammock panel having a panel first end and a panel second end wherein the panel first end is attached to a first erecting structure and the panel second end is attached to a second erecting structure, and (b) one or more panel perimeter apertures and one or more panel perimeter sleeves is proximal each panel end.

A fourth aspect of the invention comprises a convertible hammock-shade tent configurable as a shade tent and a hammock comprising (I) a plurality of tiers comprising a first tier and a second tier wherein (a) the second tier has a plurality of perimeter sleeves and (b) each tier has positioned thereon a plurality of apertures; (II) a plurality of vertically adjustable telescoping posts comprising a first, second, third, and fourth post wherein each (a) is attachable to the first and second tiers by an attachment device and (b) comprises a plurality of post segments, each with an upper and a lower end, comprised of at least a first post segment with a lower end configured for securing the post to the ground and attaching the post to the first tier and a second post segment positioned above the first post segment and configured for attaching the post to the second tier, and a center post segment between the first and second post segments; (III) wherein each tier is a quadrilateral and each telescoping post is positioned at a corner of each tier; (IV) wherein the tiers and posts can be configured for use as a shade tent wherein the first tier comprises the shade tent floor and the second tier comprises the shade tent canopy positioned above the first tier and wherein (a) a bendable member is inserted into at least one second tier perimeter sleeve, and (b) a second tier support system is positioned below and proximal the second tier and comprises a first and a second cross brace, with each cross brace having a first and a second end, and a plurality of cross brace attachment members, wherein each cross brace end is attached to a cross brace attachment member attached to a second post segment of a post; and (V) wherein one tier can be configured for use as a hammock, wherein (a) the tier comprises a hammock panel having a panel first end and a panel second end wherein the panel first end is attached to a first erecting structure and the panel second end is attached to a second erecting structure, and (b) one or more panel perimeter apertures and one or more panel perimeter sleeves is proximal each panel end.

Further additional, advantageous aspects of the invention, such as variants of the aspects of the invention disclosed above, will become apparent to one of ordinary skill in the art upon review of the following description of the embodiments of the invention and the claims and with reference to the accompanying drawings.

By way of example only, specific embodiments of the invention will now be described, with reference to the accompanying drawings, in which:

DETAILED DESCRIPTION OF THE INVENTION

Figure 1:
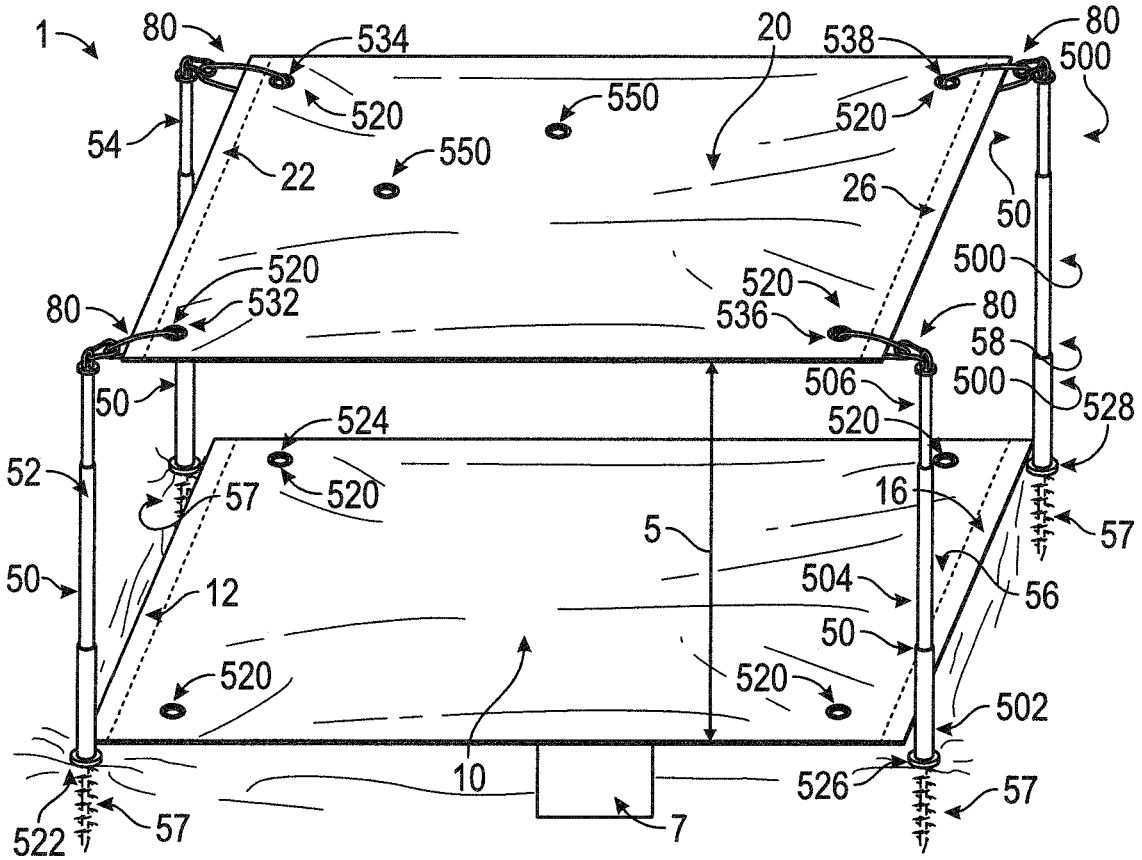
FIG. 1 is a perspective view of the present invention in a shade tent configuration.
Figure 10:
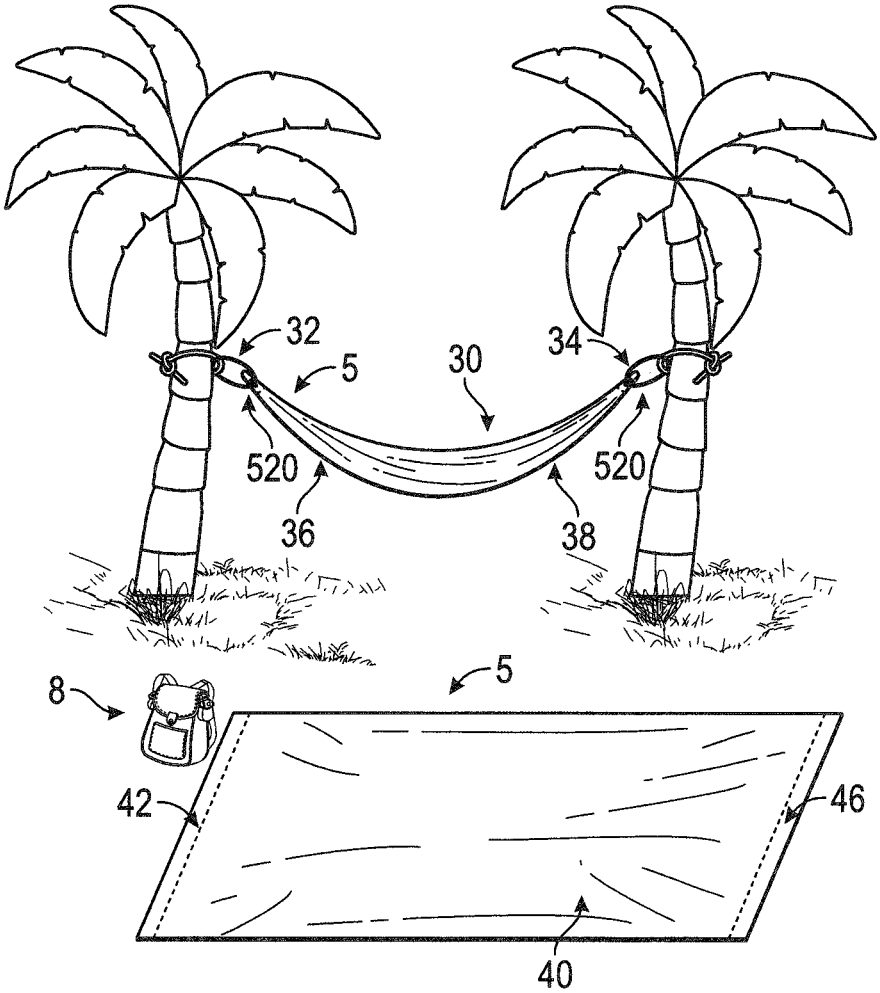
FIG. 10 is a perspective view of the present invention in a hammock configuration.

Referring to FIGS. 1, 3-9, and 12, which are varying views of the present invention or elements thereof in a single or multi-shade tent configuration, a convertible hammock-shade tent 1 presents a two-tiered shade tent comprised of (i) a plurality of tiers 5 comprising a first tier 10 and a second tier 20; and (ii) a plurality of vertically adjustable telescoping posts 50 comprising a first telescoping post 52, a second telescoping post 54, a third telescoping post 56, and a fourth telescoping post 58 wherein each of the posts 50 is attachable to the first and second tiers 10 and 20. Each of the telescoping posts 50 and tiers 5 and fixtures or structures related thereto and disclosed herein used for the fastening or attachment of these to form the tent or hammock configuration of the convertible hammock-shade tent 1 are (i)

substantially foldable for ease of storage and carrying and (ii) packed, stored, and easily toted in a backpack or carry tote 8 as shown in FIG. 10.

Each of the plurality of tiers 5 can be manufactured from one or more of many materials known in the art, including but not limited to cotton canvas with or without polyvinyl chloride (PVC) coating, polycotton canvas with or without PVC coating, polyester, nylon, or similar material. Moreover, each of the plurality of tiers 5 can present one of a variety of known shapes, including but not limited to circular or quadrilateral in shape. In the present embodiment, at least one of the plurality of tiers 5 is quadrilateral in shape having four edges and four corners, more preferably both such tiers 5 are quadrilateral in shape.

Each of the telescoping posts 50 of convertible hammock-shade tent 1 can be manufactured from one or more of many materials known in the art, including stainless steel or other metal with or without a plastic or other polymer coating, plastic with or without a polymer coating or similar light weight and sturdy materials. Moreover, each of the plurality of telescoping posts 50 can have any one of many known cross sectional shapes, including rectangular, square, circular, or other geometric shapes.

Each of the plurality of telescoping posts 50 of convertible hammock-shade tent 1 is vertically adjustable, each telescoping post 50 comprising at least a (i) first post segment 502 with an upper and a lower end wherein such first post segment 502 comprises the lower-most post segment when a post 50 is erected and the lower end of which is configured to be attachable to a tier 5; and (ii) second post segment 506 with an upper and a lower end wherein such second post segment 506 comprises the upper-most post segment when a post 50 is erected and the upper end of which is configured to be attachable to a tier 5. In a preferred embodiment, the plurality of tier post segments 500 comprises three post segments comprising a first post segment 502, a second post segment 506, and a center post segment 504 between first post segment 502 and second post segment 506, wherein (i) the center post segment 504 is configured to nest within the first post segment 502, (ii) the second post segment 506 is configured to nest within the center post segment 504, and (iii) at least a portion of each of first post segment 502 and center post segment 504 proximal the upper end thereof is hollow so as to provide a void into which the lower end of center post segment 504 and second post segment 506 respectively can nest and be disposed when retracted into first post segment 502 and center post segment 504, respectively.

Each of the plurality of tiers 5 has positioned thereon one or more tier perimeter apertures 520. A tier perimeter aperture 520 comprises an opening in the tier 5 structure and can be positioned at any point along or proximal the tier 5 perimeter. Preferably and in an embodiment of the invention wherein one or more tiers 5 is quadrilateral in shape, one or more tier perimeter apertures 520, more preferably a plurality of tier perimeter apertures 520, is positioned at each corner of each such quadrilateral tier 5.

With reference to FIGS. 1-2, 5-8, and 12, the second post segment 506 and the first post segment 502 of a telescoping post 50 is attached to a tier 5 by an attachment device 80. The attachment device comprises one or more structures known in the art used to secure one structure to another, such as one or more clips including carabiner clips, hooks, elastic or non-elastic cords or belts, snappable or otherwise closable and securable loops. The upper end of the second post segment 506 and the lower end of the first post segment 502 of each telescoping post 50 is configured to have attached thereto an attachment device 80, with the attachment device 80 in turn attached to a tier 5 by being passed through a tier perimeter tier aperture 520.

The attachment of a telescoping post 50 to a tier 5 by an attachment device 80 passed through a tier perimeter aperture 520 enables adjustment of the size of the convertible hammock-shade tent 1, with each telescoping post 50 capable of being positioned proximal one of multiple positions along the perimeter of a tier 5 at which a tier perimeter aperture 520 is positioned, thereby adjusting the usable surface area of a tier 5 so that the surface area of the first and second tiers 10 and 20 usable as a floor and canopy of the convertible hammock-shade tent 1, respectively, is adjustable to suit the particular needs of a user in the particular environment in which the convertible hammock-shade tent 1 is erected. Moreover, one or more tier center apertures 550 comprises an opening in the tier 5 material to allow for air to flow through the tier 5, either downward or upward through the tier center aperture 550, thereby allowing for the air pressure above and below a tier 5 to equalize, minimizing resistance to inversion of the tier 5.

Figure 3:
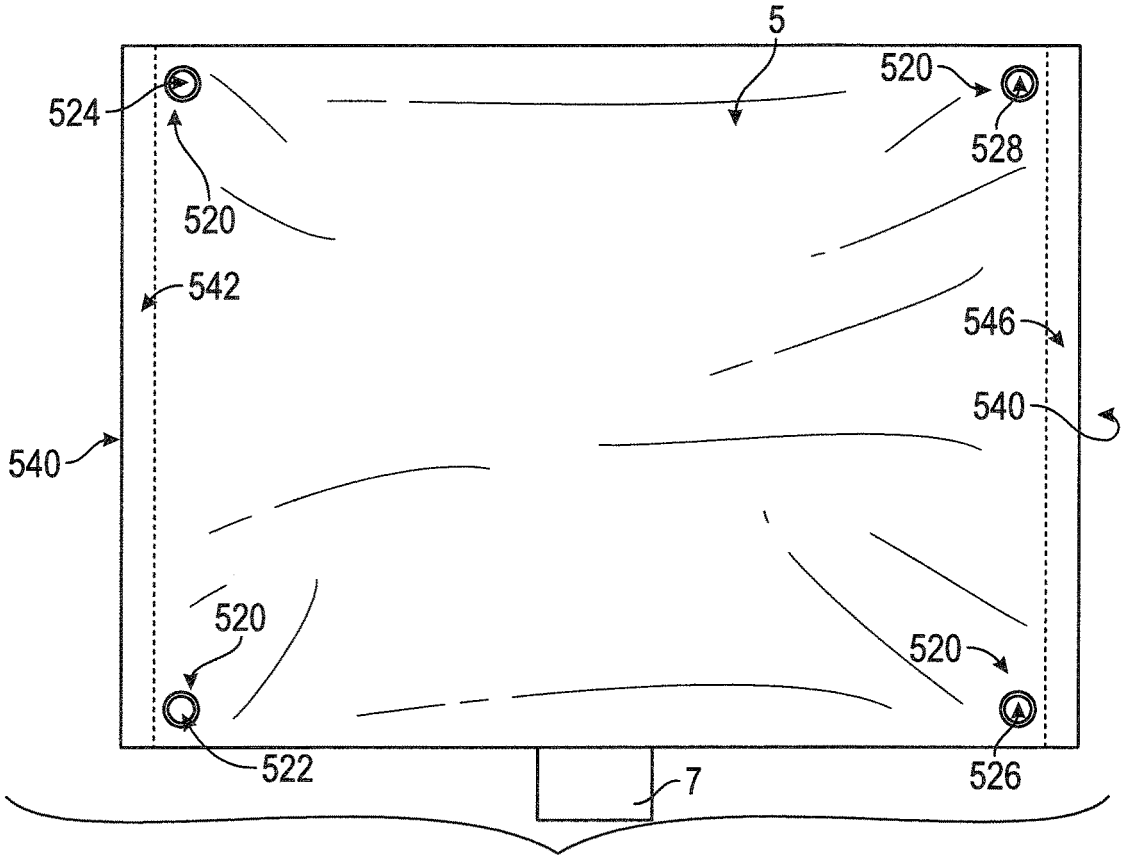
FIG. 3 is an overview of a tier of the present invention.
Figure 11:
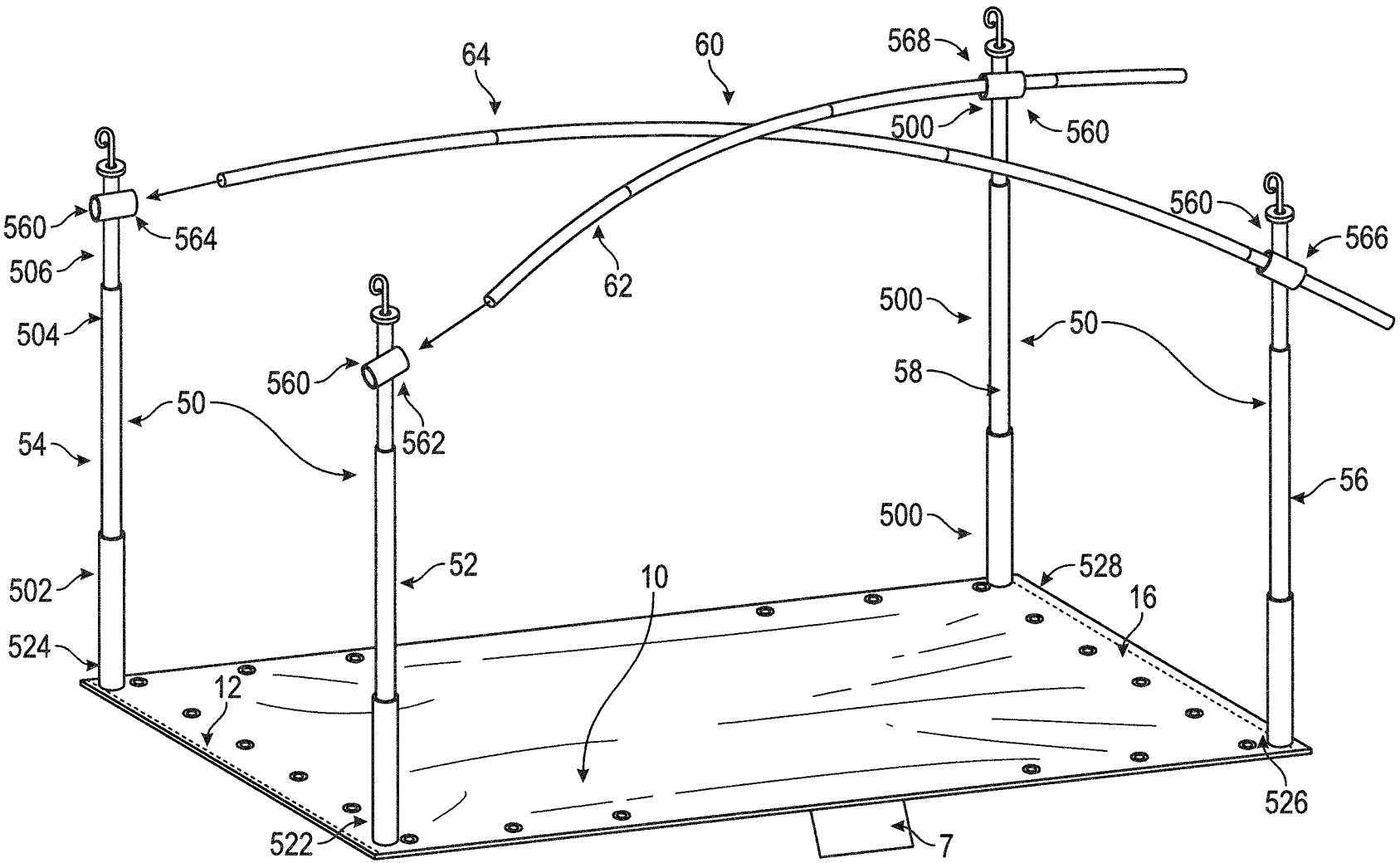
FIG. 11 is a perspective view of the present invention in the stages of assembly in a shade tent configuration.

Additionally, in an embodiment and with reference to FIGS. 1, 3, and 11, attached to the perimeter of at least one tier 5 of the convertible hammock-shade tent 1, preferably the first tier 10, is a closable pouch 7 with a closeable pouch opening. The closable pouch 7 is provided for storage of a blanket or other small items and comprises a member, quadrilateral in shape, comprised of upper and lower flaps (I) joined together at the flap perimeters distal from the perimeter of the tier 5 to which closable pouch 7 is attached and (ii) joinable so as to form the closeable pouch opening, such as by Velcro®, zipper, or other means known in the art, at the flap perimeters proximal the perimeter of such tier 5. Alternatively, and in an embodiment of the invention, the closeable pouch 7 is removably attachable to tier 5 using one or more means known in the art, such as snaps, clips, ties, or Velcro®.

With reference to FIGS. 1, 3-4, and 6-8, formed at the perimeter of each tier 5 is a tier perimeter sleeve 540 with a head end and a tail end and an exterior end distal from the center of the tier 5 and an interior end proximal the center of the tier 5 wherein the head and tail ends are relatively short compared to the interior and exterior ends. Each tier perimeter sleeve 540 is comprised of an upper and a lower sleeve portion. The exterior ends of the upper and lower sleeve portions of each tier perimeter sleeve 540 are attached and the interior ends of the upper and lower sleeve portions of each tier perimeter sleeve 540 are attached. Each tier perimeter sleeve 540 is generally hollow and at least one of the head and tail ends of each tier perimeter sleeve 540 comprises an opening, with each tier perimeter sleeve 540 configured as (i) an open-ended hollow member when only one of the head and tail ends of the tier perimeter sleeve 540 is open or (ii) a double open-ended hollow member when both the head and tail ends of each tier perimeter sleeve 540 are open.

To provide structural support to a tier 5, a structural member (not numbered or depicted) can be accommodated in the hollow cavity of a tier perimeter sleeve 540 by inserting any such member through the opening of a tier perimeter sleeve 540 positioned at one or more of the head and tail ends of the tier perimeter sleeve 540 and pushing such member through the tier perimeter sleeve 540 to introduce such member into the hollow cavity of the tier perimeter sleeve 540. Such a structural member is preferably tubular or cylindrical. The tier perimeter apertures 520 on each of the plurality of tiers 5 are positioned to the interior of the tier perimeter sleeve 540.

Figure 6:
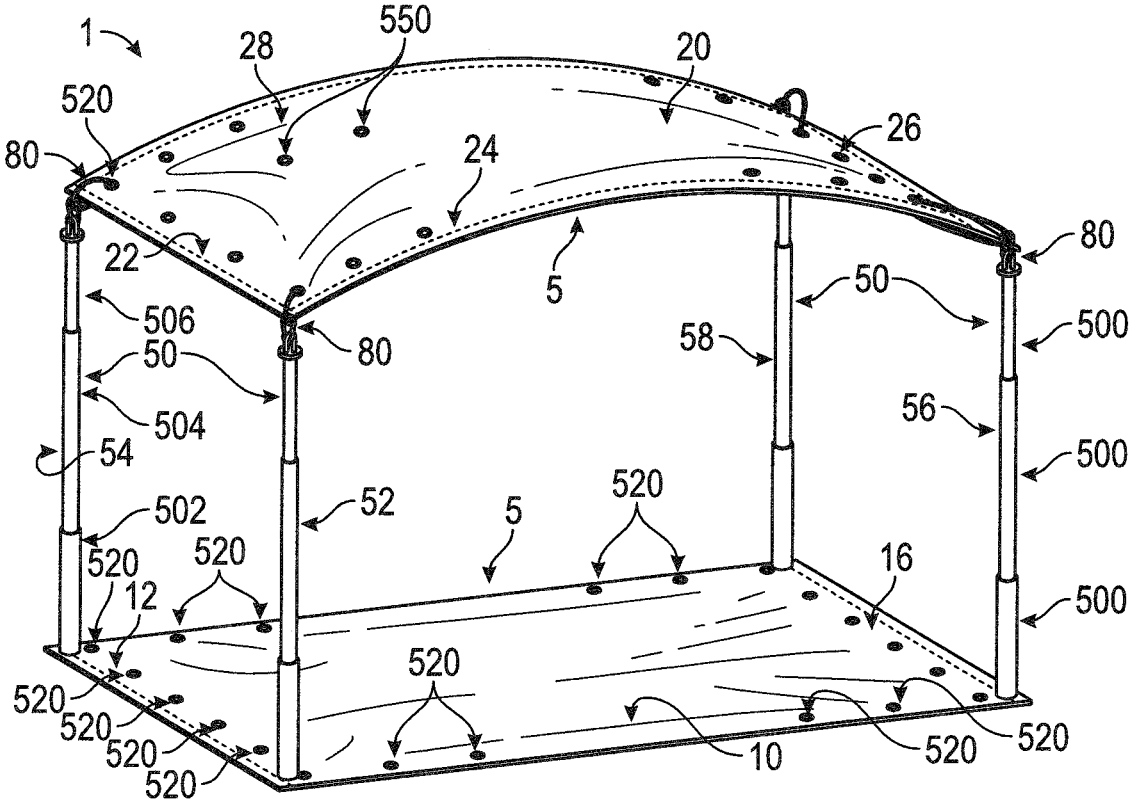
FIG. 6 is a perspective view of the present invention in a shade tent configuration.
Figure 7:
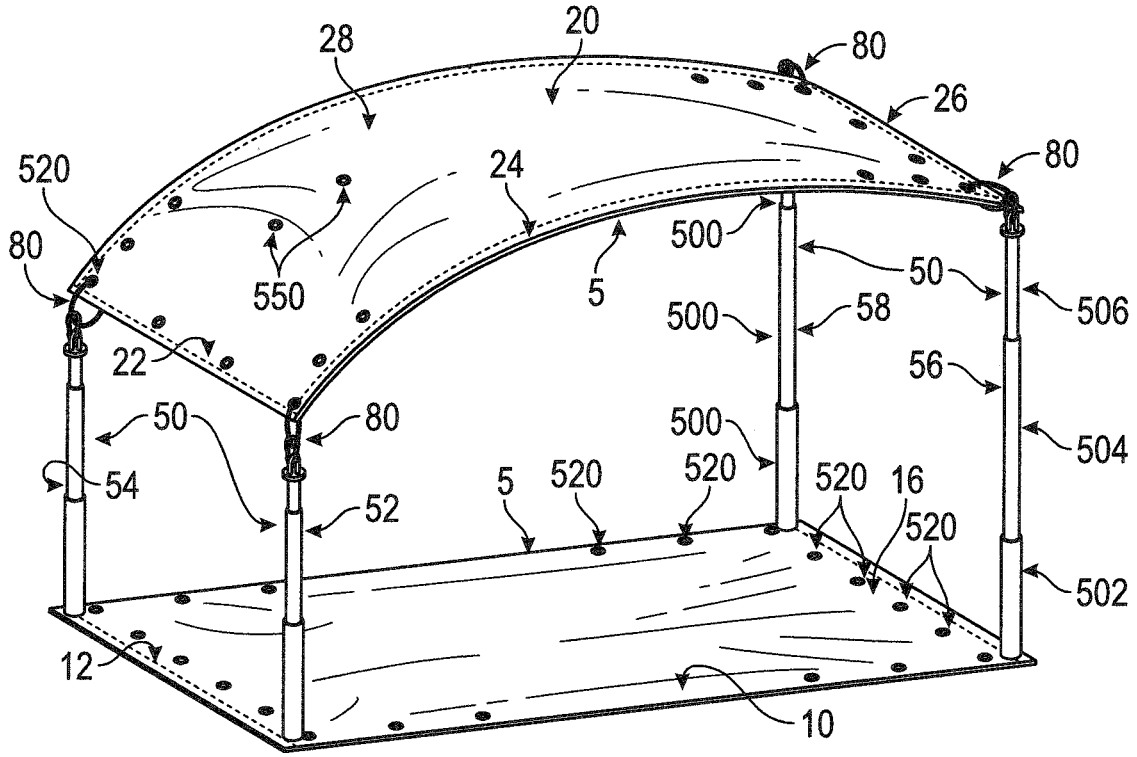
FIG. 7 is an alternative perspective view of the present invention in a two-tiered shade tent configuration.
Figure 8:
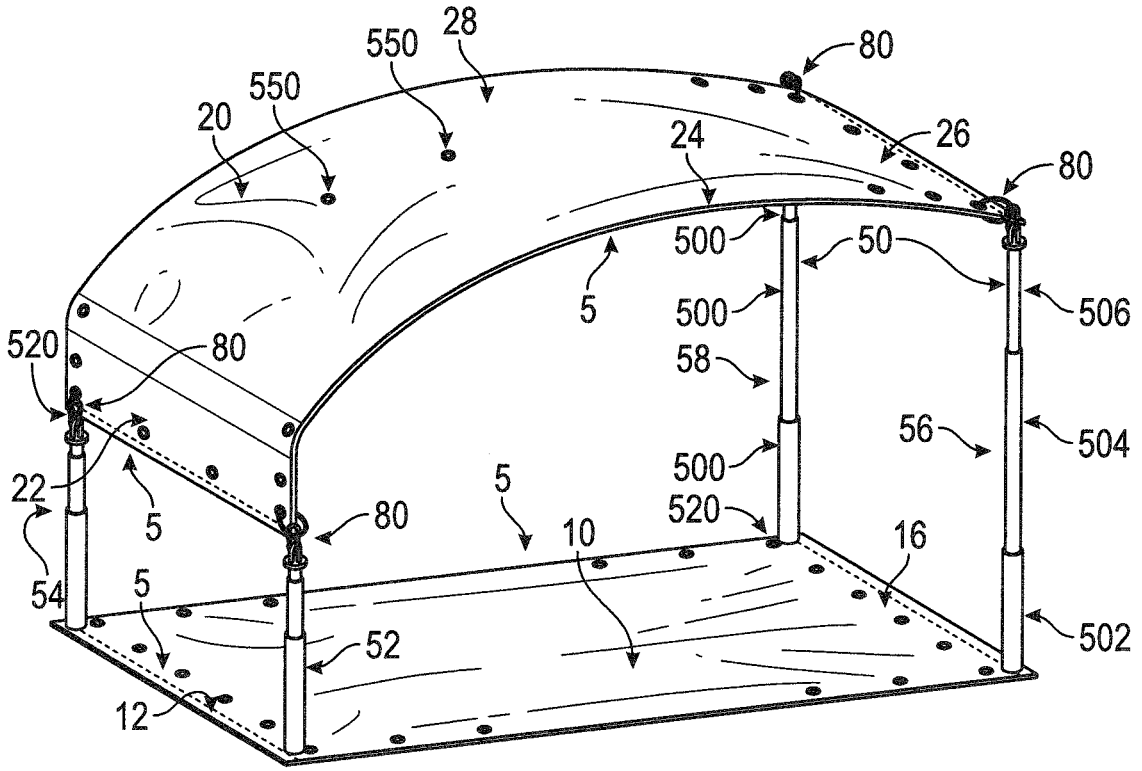
FIG. 8 is an additional alternative perspective view of the present invention in a shade tent configuration.

With reference to FIGS. 1, 6-8, and 11, in an embodiment of the convertible hammock-shade tent 1, one or more first tier edge sleeves 540 is formed along the perimeter of the first tier 10. Formed at a first and a second edge of the first tier 10 is a first tier first edge sleeve 12 and a first tier second edge sleeve 16, respectively, with the first tier second edge sleeve 16 opposing the first tier first edge sleeve 12. With reference to FIGS. 6-8, a plurality of tier perimeter sleeves is formed along the perimeter of the second tier 20. The plurality of tier perimeter sleeves of the second tier 20 comprise (i) a second tier first sleeve 22, (ii) a second tier second sleeve 26 opposing the second tier first sleeve 22, (iii) a second tier third sleeve 24, and (iv) a second tier fourth sleeve 28 opposing the second tier third sleeve 24.

Into each of the second tier perimeter sleeves 22, 24, 26, and 28, and preferably additionally one or more of the first tier perimeter sleeves 12 and 16, is inserted a segmented structural member (not numbered or depicted) comprised of a plurality of segments and plurality of flex points wherein adjoining segments are joined together at a flex point. Each bendable segmented structural member extends generally along the entire tier perimeter sleeve length and is sufficiently bendable to allow for curvature of the respective tier. Along the length of each bendable segmented structural member is a plurality of flex points at which the angle of the first segment of bendable structural member on one side of the flex point relative to a substantially vertical axis parallel to an erected telescoping post 50 passing through the flex point can be adjusted by bending the second segment of bendable structural member on the other side of the flex point so that the angle of the second segment of bendable structural member relative to the vertical axis differs. In this manner, the angle of any of the segments of the bendable structural member can vary from 0 degrees (segment parallel to the vertical axis) to 90 degrees (segment perpendicular to the vertical axis). By way of example only and not of limitation and with reference to FIGS. 7 and 8, the bendable segmented structural members in the second tier third sleeve 24 and second tier fourth sleeve 28 is bent by bending one or more of the segments of such bendable segmented structural members proximal the first telescoping post 52 and second telescoping posts 54, respectively to present an overall concave downward shape to second tier 20 relative to the ground surface on which the first tier 10 is disposed.

When the convertible hammock-shade tent 1 is configured as a shade tent 1, each tier 5 is generally horizontally oriented and parallel to the ground surface and each telescoping post 50 is generally vertically oriented, with the vertical height of each telescoping post 50 adjustable by alternatively extending (increasing the vertical height of a telescoping post 50) or retracting (decreasing the vertical height of a telescoping post 50) the second post segment 506 away from or toward the first post segment 502. The vertical adjustability of each of the plurality of the posts 50 allows the convertible hammock-shade tent 1 to have (i) an adjustable substantially uniform canopy height when each of the plurality of the posts 50 has the same vertical height, such as what is shown in FIGS. 1, 6, and 11-12, or (ii) an adjustable variable canopy height that varies if the vertical height of one or more of the plurality of posts 50 differs from the vertical height of any of the remaining posts 50, such as what is shown in FIGS. 7 and 8.

With reference to FIGS. 1, 5-8, and 11, the lower end of the first post segment 502 of each telescoping post 50 is configured to secure the convertible hammock-shade tent 1 to the ground and the first tier 10. At least a portion of the upper end of the first post segment 502 is hollow so as to provide a void for the second post segment 506 to nest and be disposed within the first post segment 502, with the lower end of the second post segment 506 retractable into or extendable out of the upper end of (i) the first post segment 502 in embodiments wherein each post 50 comprises a first post segment 502 and a second post segment 506 only or (ii) the center post segment 504 in embodiments wherein each post 50 comprises a first post segment 502, a center post segment 504, and a second post segment 506.

Figure 2:
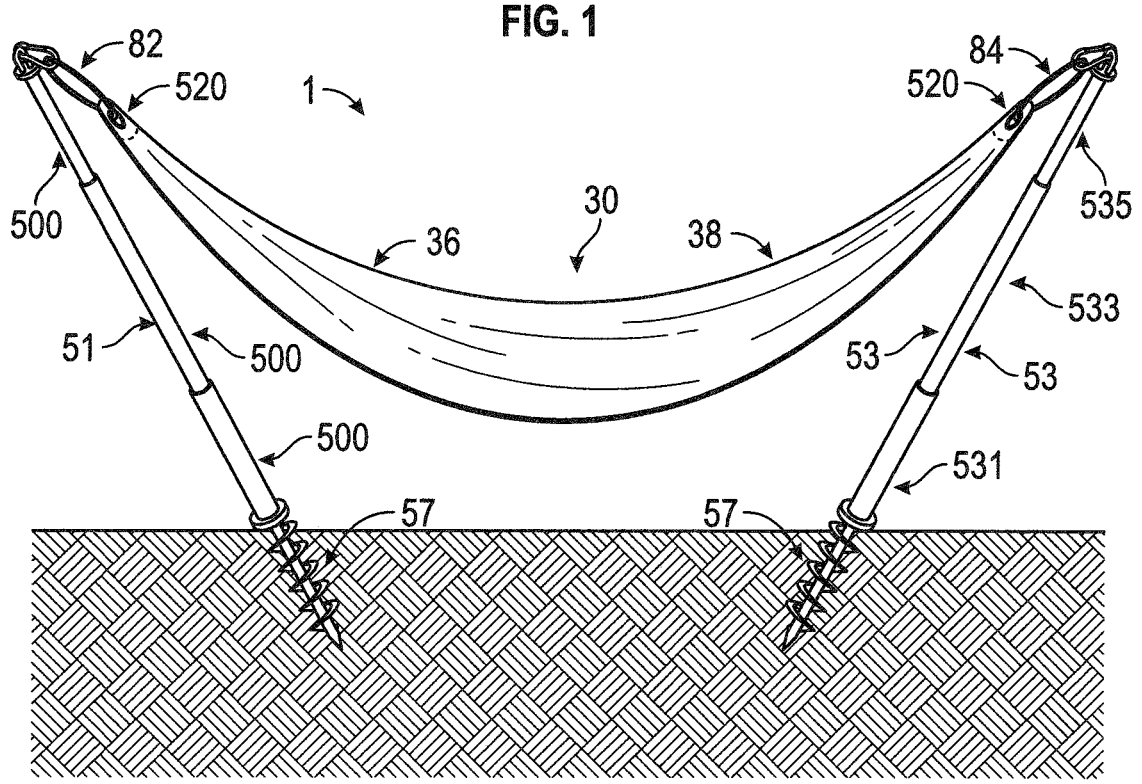
FIG. 2 is a perspective view of the present invention in a hammock configuration.

With respect to the configuration of the lower end of the first post segment 502 of each telescoping post 50 to secure the convertible hammock-shade tent 1 to the ground, in one embodiment of the convertible hammock-shade tent 1 and with reference to FIGS. 1-2, the lower end of the first post segment 502 of one or more of the plurality of posts 50 comprises a threaded shank 57 characterized by a helical ridge along substantially the axial length of shank 57. Such helical ridge is akin to the external thread of a screw, wherein such shank 57, when turned, digs in and wedges into the ground to prevent post pull-out when the telescoping post 50 is secured to the ground. In an alternative preferred embodiment, a threaded shank 57 is attachable to the lower end of the first post segment 502 of one or more of the plurality of posts 50, more preferably each telescoping post 50, with such attachment of the threaded shank 57 to the telescoping post 50 effectuated using one of many methods of attachment known in the art, such as (i) threading the shank 57 to the telescoping post 50, (ii) inserting the telescoping post 50 into the shank 57 and securing the telescoping post 50 to the shank 57 when the top of shank 57 is open and at least a portion of the upper portion of the shank 57 is hollow, (iii) a quick-release pin mechanism such as a push-pull pin or positive-locking pin, or (iv) a ball-lock pin.

In an embodiment of the invention wherein tier 5 comprises the first tier 10, the lower end of the first post segment 502 of each of the telescoping posts 52, 54, 56, and 58 is attached to an attachment device 80 which in turn is passed through first tier apertures 522, 524, 526, and 528, respectively (see FIG. 1). Additionally, wherein tier 5 comprises the second tier 20, the upper end of the second post segment 506 of each of the telescoping posts 52, 54, 56, and 58 is attached to an attachment device 80 which in turn is passed through second tier apertures 532, 534, 536, and 538, respectively (see FIG. 1).

With reference to FIG. 11, positioned proximal the upper end of the second post segment 506 of each of the plurality of posts 50 is a second tier support system which presents a diagonal horizontal bracing system that provides support for the second tier 20 when erected as the canopy of convertible hammock-shade tent 1. The diagonal horizontal bracing system providing support to second tier 20 comprises a plurality of cross braces 60, each with a head end and a tail end, comprising a first cross brace 62 extending from and attachable indirectly to each of the first telescoping post 52 and the fourth telescoping post 58 when erected, and a second cross brace 64 extending from and attachable indirectly to each of the second telescoping post 54 and the third telescoping post 56 when erected. When erected, the cross braces 62 and 64 are proximal at a point approximately over the center of the second tier 20 when deployed and the center of the first tier 10 when the first tier 10 disposed on the ground.

The second tier support system further comprises a plurality of brace attachment members 560, with each brace attachment member 560 attachable to the second post segment 506 of each post 50, wherein each brace attachment member 560 has a first end that is open and oriented proximally toward the center of convertible hammock-shade tent 1 and a second end which can be open or closed and is oriented distally from the center of convertible hammock-shade tent 1. When erected, the plurality of cross braces 60 of the second tier support system are positioned below and proximal the second tier 20 and secured thereto by passing each cross brace 60 through the one or more second tier brace loops 570 (FIG. 9) formed on the underside of the second tier 20 and positioned diagonally on second tier 20, with each of the brace attachment members 560 positioned below and proximal the top of the telescoping post 50 to which it is attached. The passing of each cross brace 60 through the one or more second tier brace loops 570 maintains the diagonal orientation of each cross brace 60 when erected and attached to two tier posts 50. If needed, the second post segment 506 upper end of each post 50 can attach to an attachment device 80 which in turn is attached to a second tier brace loop 570 in lieu of being passed through a tier perimeter aperture 520 of second tier 20 in order to form a second tier 20—post 50 attachment.

At least a portion of the interior of each brace attachment member 560 proximal the first end thereof is hollow so as to provide a void into which the tail or head end of a cross brace 60 can be inserted and secured therein. Each of the plurality of brace attachment members 560 is attachable to a telescoping post 50 using means known in the art, such as by attaching the brace attachment member 560 by screws or other securing device to the telescoping post 50.

With reference to FIG. 11, the plurality of brace attachment member 560 comprise a first brace attachment member 562 attachable to the first telescoping post 52 at the second post segment 506 thereof, a second brace attachment member 564 attachable to the second telescoping post 54 at the second post segment 506 thereof, a third brace attachment member 566 attachable to the third telescoping post 56 at the second post segment 506 thereof, and a fourth brace attachment member 568 attachable to the fourth telescoping post 58 at the second post segment 506 thereof. The head end of first cross brace 62 is attached to the first brace attachment member 562 attached to the first telescoping post 52 at the second post segment 506 thereof, with the first cross brace 62 extending to the fourth telescoping post 58 with the tail end of the first cross brace 62 attached to the fourth brace attachment member 568 attached to the fourth telescoping post 58 at the second post segment 506 thereof. Along the length of first cross brace 62 when extending between the first and fourth telescoping posts 52 and 58, respectively, the first cross brace 62 is passed through the one or more second tier brace loops 570 formed on the underside of the second tier 20 and positioned diagonally extending along the diagonal path followed by first cross brace 62 from first telescoping post 52 to fourth telescoping post 58 when erected. The head end of the second cross brace 64 is attached to the second brace attachment member 564 attached to the second telescoping post 54, with the second cross brace 64 extending to the third telescoping post 56 with the tail end of the second cross brace 64 attached to the third brace attachment member 566 attached to the third telescoping post 56.

The orientation of a brace attachment member 560 is adjustable so that the angle between the top of the second post segment of a telescoping post 50 and the first end of the brace attachment member 560 attached thereto can vary, with the brace attachment member 560 pivotable around a vertical axis represented by the vertical orientation of such telescoping post 50. Additionally, the brace attachment member 560 is rotatable around the telescoping post 50 to which it is attached whereby the first end of the brace attachment member 560 can be alternately oriented toward or away from the center of the first tier 10 when the first tier 10 is disposed on the ground. This adjustability of the brace attachment members 560 allow for the presentment of an overall concave downward shape to second tier 20 relative to the ground surface on which the first tier 10 is disposed.

Figure 12:
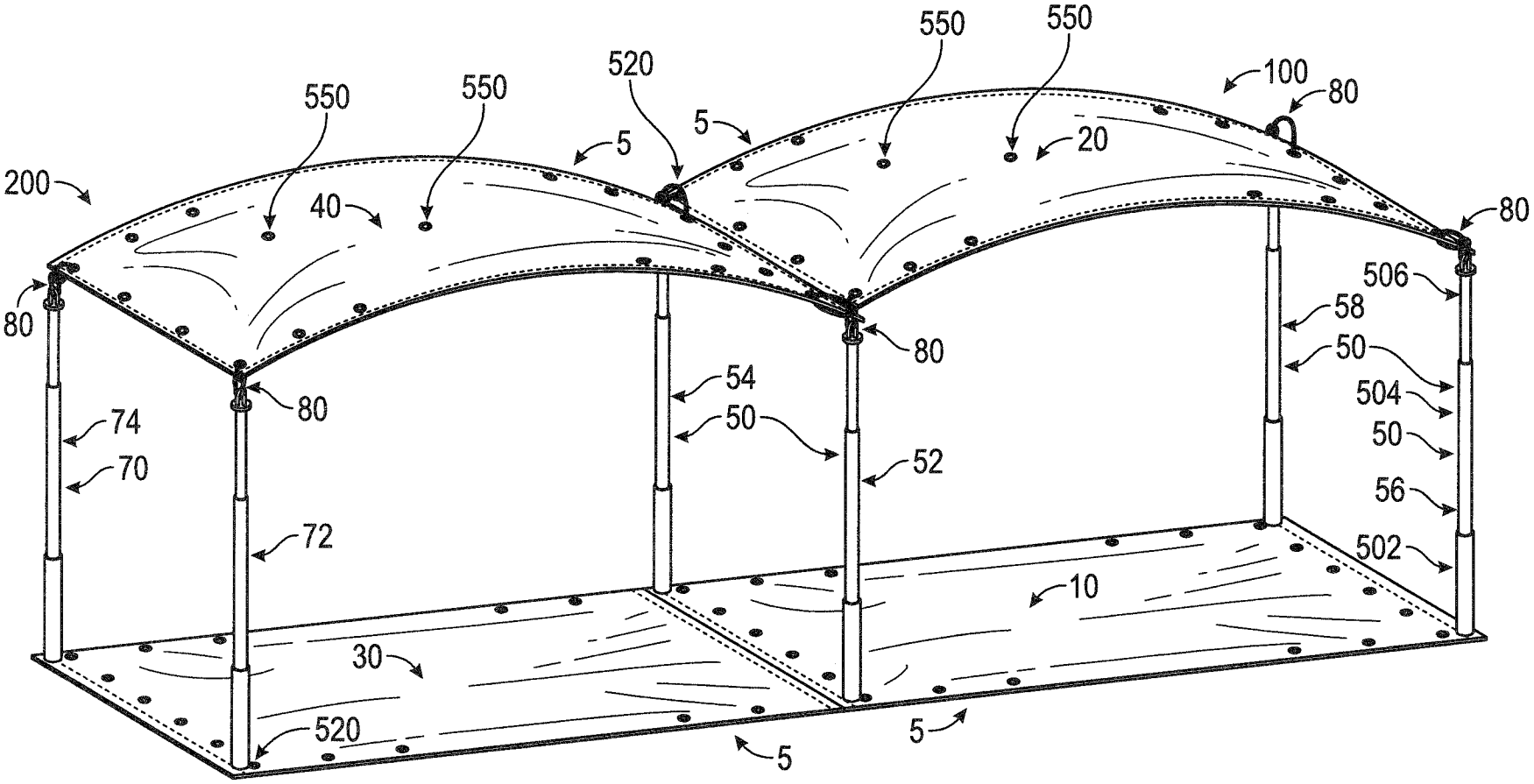
FIG. 12 is a perspective view of the present invention in a multi-shade tent configuration.

In an alternative embodiment of the convertible hammock-shade tent 1 in a shade tent configuration, two or more sets of a plurality of tiers 5 and plurality of vertically adjustable telescoping posts 50 are configured as an expanded shade tent comprised of a plurality of shade tents comprising two or more shade tents. With reference to FIG. 12, a first shade tent 100 comprises (i) a plurality of first shade tent tiers 5 comprising a first shade tent first tier 10 and a first shade tent second tier 20 and (ii) a plurality of first shade tent posts 50 comprising a first shade tent first post 52, a first shade tent second post 54, and first shade tent third post 56, and a first shade tent fourth post 58 are erected in a shade tent configuration wherein each first shade tent tier is attached at two positions to each first shade tent post. A second shade tent 200 comprises (i) a plurality of second shade tent tiers 5 comprised of a second shade tent first tier 30 opposing first shade tent first tier 10 and a second shade tent second tier 40 opposing first shade tent second tier 20 and (ii) a plurality of second shade tent posts 70 wherein a second shade tent first post 72 and a second shade tent second post 74 are positioned distal from first shade tent 100 and attached to each of the second shade tent tiers 30 and 40, and the first shade post first post 52 and first shade tent second post 54 are attached at two positions to each of the second shade tent tiers 30 and 40. Each of shade tent 100 and 200 has a diagonal horizontal bracing system providing support to first shade tent second tier 20 and second shade tent second tier 40, respectively.

When not configured as a shade tent, elements of the convertible hammock-shade tent 1 can be configured for use as a hammock and erected in a hammock configuration. Referring to FIGS. 2-5 and 9-10, which are varying views of the present invention or elements thereof in a hammock configuration, a convertible hammock-shade tent 1 in one embodiment of the invention configured as a hammock comprises (i) a hammock panel 30 comprised of one of the tiers 5, with the hammock panel 30 having a first hammock panel end 36 and a second hammock panel end 38; and (ii) a first hammock anchor 51 and a second hammock anchor 53, each such anchor 51/53 attached to an end 36/38 of the hammock panel 30 and anchoring the hammock panel 30 to the ground so as to securely erect the convertible hammock-shade tent 1 in a hammock configuration. In one embodiment of the invention, one or both of the hammock anchors 51 and 53 comprises a vertically adjustable telescoping post 50 such as those described above. In another embodiment of the invention, one or both of the hammock anchors 51 and 53, preferably both, comprises a vertically-oriented structure, such as a tree or a pole.

Figure 4:
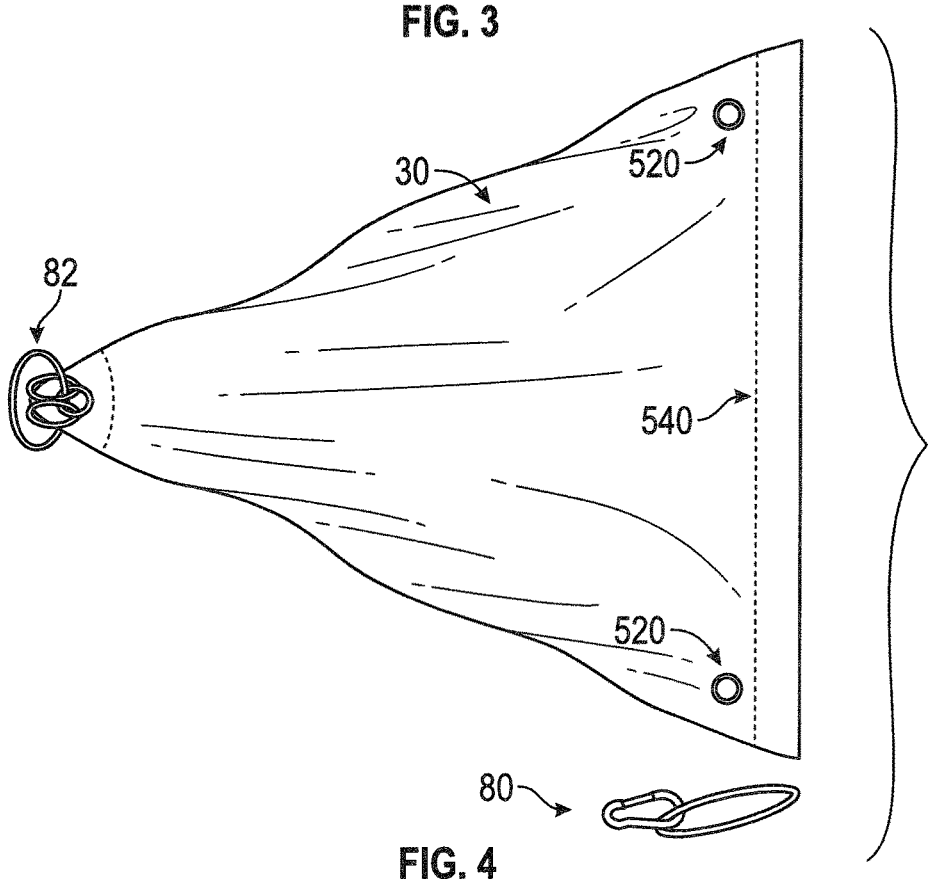
FIG. 4 is a partial overview of a tier of the present invention.
Figure 9:
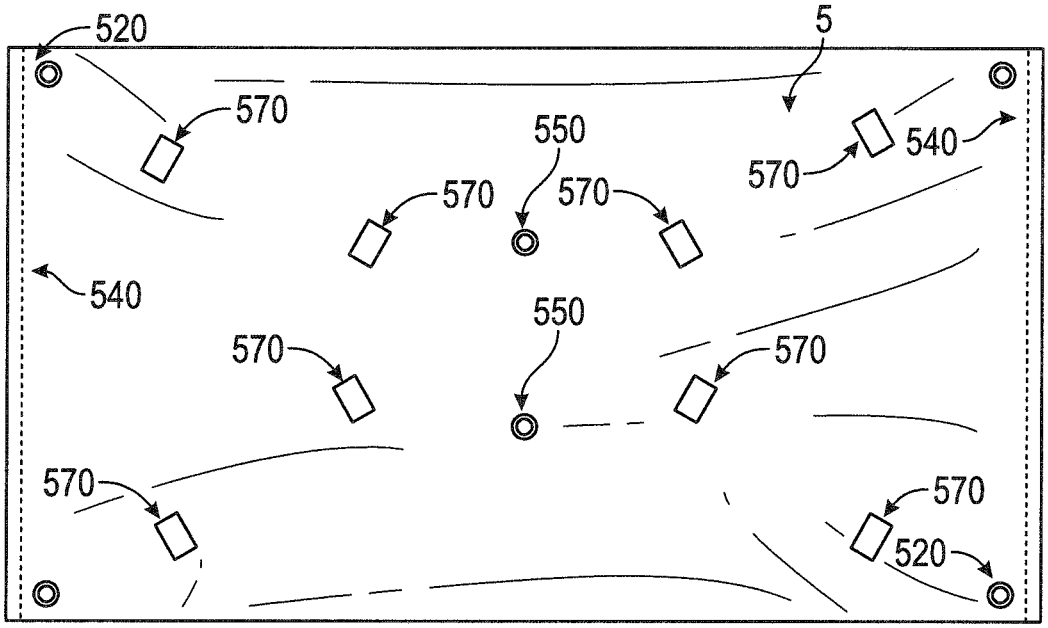
FIG. 9 is an overview of a tier of the present invention.

With reference to FIGS. 3-4 and 9, the hammock panel 30 has a plurality of hammock panel perimeter sleeves 540 such as those described above as pier perimeter sleeves 540, with a first hammock panel perimeter sleeve 542 proximal the first hammock panel end 36 and a second hammock panel perimeter sleeve 546 proximal the second hammock panel end 38. Moreover, the hammock panel 30 has positioned thereon a plurality of panel perimeter apertures 520 wherein each aperture 520 comprises an opening in the panel 30 material and is positioned to the interior of the panel perimeter sleeve 540. One or more such panel perimeter apertures 520 is positioned proximal each of the first and second ends 36 and 38 of the hammock panel 30. Preferably and additionally, positioned proximal the center of the hammock panel 30 of convertible hammock-shade tent 1 are one or more panel center apertures 550 which provide an opening in the hammock panel 30 structure for ventilation and cooling purposes.

Figure 5:
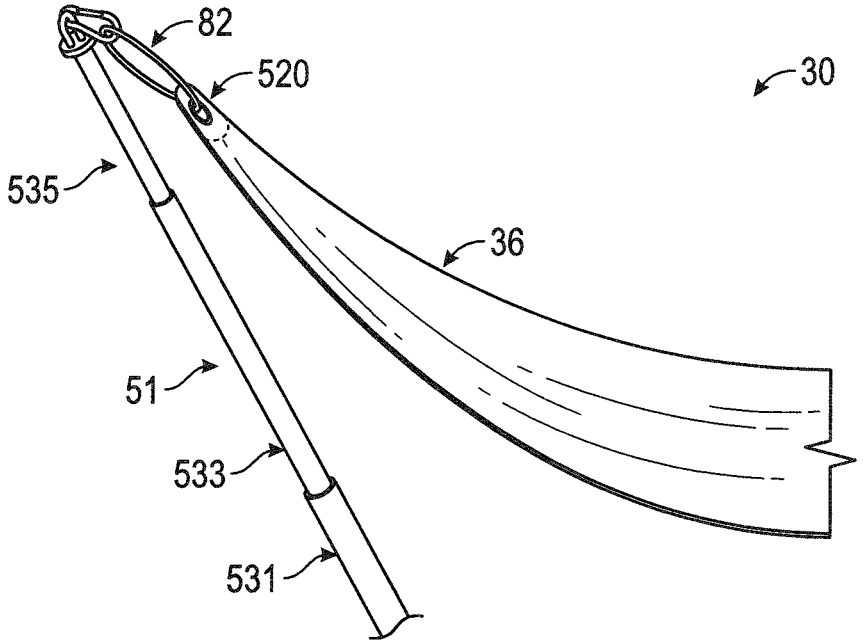
FIG. 5 is a perspective view of a telescoping post and a tier of present invention in a hammock configuration.

Furthermore, and with reference to FIGS. 2 and 5, each of the hammock anchors 51 and 53 comprises one of the plurality of telescoping posts 50 described above, each comprised of a plurality of post segments 500 comprising a first post segment 531 constituting the lower-most post segment and a second post segment 535 positioned above the first post segment 531 and constituting the upper-most post segment, wherein each hammock anchor 51 and 53 is attachable to the hammock panel 30 using a hammock anchor attachment device 80 which comprises one or more structures known in the art used to secure one structure to another, such as one or more clips including carabiner clips, hooks, elastic or non-elastic cords or belts, or snappable or otherwise closable and securable loops. The upper end of the second post segment 535 of each of the hammock anchors 51 and 53 is configured to be attached to an end 36 or 38 of the hammock panel 30 and the lower end of the first post segment 531 of each of the hammock anchors 51 and 53 is configured to be secured to the ground so as to secure the convertible hammock-shade tent 1 in the hammock configuration. During use of the convertible hammock-shade tent 1 in the hammock configuration wherein one of the tiers 5 is used as the hammock panel 30, the other tier 5 can be used as a blanket 40 as depicted in FIG. 10.

In a preferred embodiment of the invention, a center post segment 533 is disposed between first post segment 531 and second post segment 535, wherein (i) the center post segment 533 is configured to nest within the first post segment 531, (ii) the second post segment 535 is configured to nest within the center post segment 533, and (iii) at least a portion of each of first post segment 531 and center post segment 533 proximal the upper end thereof is hollow so as to provide a void into which the lower end of center post segment 533 and second post segment 535 respectively can nest and be disposed when retracted into first post segment 531 and center post segment 533, respectively.

In an embodiment of the convertible hammock-shade tent 1 and with reference to FIG. 2, the lower end of the first post segment 531 of one or more of the hammock anchors 51 and 53 comprises a threaded shank 57 as described earlier. In an alternative embodiment, a threaded shank 57 is attachable to the lower end of the first post segment 531 of one or more of the hammock anchors 51 and 53, with such attachment of the threaded shank 57 to the first post segment 531 of any such anchor 51 and/or 53 effectuated using one or more methods or devices used for attaching two structures.

With reference to FIGS. 2 and 4-5 and in an embodiment of the invention in a hammock configuration with a tier 5 comprising a hammock panel 30, the first hammock anchor 51 is attached to the hammock panel first end 36 on which is positioned one or more tier perimeter apertures 520 proximal the first hammock panel end 36 by a first hammock anchor attachment device 82 which is passed through a tier perimeter aperture 520 proximal the first hammock panel end 36. Additionally, in such an embodiment and with reference to FIGS. 2 and 4-5, the second anchor 53 is attached to a second hammock panel end 38 on which is positioned one or more tier perimeter apertures 520 proximal the second hammock panel end 38 by a second hammock anchor attachment device 84 which is passed through a tier perimeter aperture 520 proximal the second hammock panel end 38.

Moreover, in an embodiment of the convertible hammock-shade tent 1 and with reference to FIGS. 2, and 4-5, one or more panel perimeter apertures 520 proximal to an end of the hammock panel 30 are overlaid and a hammock anchor attachment device 80 is passed through the overlaid panel perimeter apertures 520 and attached to the upper end of the second post segment 535 of a hammock anchor 51. In an alternative of such embodiment, one or more panel perimeter apertures 520 proximal to the first hammock panel end 36 are overlaid and one or more panel perimeter apertures 520 proximal the second hammock panel end 38 are overlaid, and a first hammock anchor attachment device 82 is passed through the overlaid panel perimeter apertures 520 of the first hammock panel end 36 and a second hammock anchor attachment device 84 is passed through the overlaid panel perimeter apertures 520 of the second hammock panel end 38, with the first hammock anchor attachment device 82 attached to the upper end of the second post segment 535 of hammock anchor 51 and the second hammock anchor attachment device 84 attached to the upper end of the second post segment 535 of hammock anchor 53.

In another embodiment of the convertible hammock-shade tent 1 when erected in a hammock configuration, each of the panel perimeter sleeves 540 of the hammock panel 30 is open on each of the two panel perimeter sleeve ends and a securing member, such as a rope or other flexible member, can be passed through the open first end of the panel perimeter sleeve 540, the entirety of the length of the panel perimeter sleeve 540, and out the open second end of the panel perimeter sleeve 540, with one or both of the hammock panel ends 36 and/or 38 of hammock panel 30, preferably both hammock panel ends 36 and 38, secured by the securing member to a vertically-oriented structure, such as a tree or pole (see FIG. 10), with such structure thereby providing one or both of the anchors of the hammock panel 30, preferably both anchors 51 and 53 in lieu of a telescoping post 50 serving as the hammock anchor 51 and/or 53. Alternatively, one or more of the securing members is passed through a panel perimeter sleeve 540 and is attached to the upper end of the second segment 535 of one or both hammock anchors 51 and/or 53 to thereby secure the hammock panel 30 to the hammock panel 51 and/or 53 where a telescoping post 50 serves as the hammock anchor 51 and/or 53.

Although the description above contains much specificity, such description specificity should not be construed as limiting the scope of the embodiments of the invention but as merely providing illustrations of some of the presently-preferred embodiments. Thus, the scope of the invention should be determined by the appended claims and their legal equivalents, rather than by the examples given.

I claim:

1. A convertible hammock-shade tent configurable as a shade tent and a hammock comprising:

a. a plurality of tiers comprising a first tier and a second tier wherein (i) the second tier has a plurality of perimeter sleeves and (ii) each tier has positioned thereon a plurality of apertures;

b. a plurality of telescoping posts wherein (i) each is attachable to the first and second tiers by an attachment device and (ii) each with an upper and a lower end, the lower end configured for securing the post to the ground and attaching the post to the first tier and the upper end configured for attaching the post to the second tier;

c. wherein the tiers and posts can be configured for use as a shade tent wherein the first tier comprises a shade tent floor and the second tier comprises a shade tent canopy positioned above the first tier and wherein (i) a bendable member is inserted into at least one of the plurality of perimeter sleeves, and (ii) a second tier support system is positioned below and proximal the second tier; and d. wherein one tier can be configured for use as a hammock, wherein (i) the tier comprises a hammock panel having a panel first end and a panel second end wherein the panel first end is attached to a first erecting structure and the panel second end is attached to a second erecting structure, and (ii) one or more of the panel perimeter apertures and one or more of the panel perimeter sleeves is proximal each panel end.

2. The convertible hammock-shade tent configurable as a shade tent and a hammock as claimed in claim 1:

a. wherein the plurality of posts comprises (i) a plurality of first shade tent posts comprising a first shade tent first post, a first shade tent second post, a first shade tent third post, and a first shade tent fourth post; and (ii) a plurality of second shade tent posts comprising a second shade tent first post and a second shade tent second post.

3. The convertible hammock-shade tent configurable as a shade tent and a hammock as claimed in claim 1 wherein at least one of the erecting structures of the hammock in the hammock configuration comprises one of the posts and a threaded shank is attached to the lower end of said first post to secure the post to the ground.

4. The convertible hammock-shade tent configurable as a shade tent and a hammock as claimed in claim 1 wherein the configuration is that of a hammock and first and second erecting structures are is comprised of the plurality of telescoping-posts wherein the lower end of each is secured to the ground and the upper end of each is attached to one of the panel ends by one of a group consisting of (i) a hammock anchor attachment device and (ii) a securing member wherein the securing member is passed through the panel perimeter sleeve proximal to said panel end and attached to the upper end.

5. The convertible hammock-shade tent configurable as a shade tent and a hammock as claimed in claim 1 wherein a second tier support system is positioned below and proximal the second tier and comprises a first and a second cross brace, with each cross brace having a first and a second end, and a plurality of cross brace attachment members, wherein each cross brace end is attached to a respective one of the cross brace attachment members attached to the upper end of one of the plurality of telescoping posts.

6. A convertible hammock-shade tent configurable as a shade tent and a hammock comprising:

a. a plurality of tiers comprising a first tier and a second tier wherein (i) the second tier has a plurality of perimeter sleeves and (ii) each tier has positioned thereon a plurality of apertures;

b. a plurality of vertically adjustable telescoping posts wherein (i) each is attachable to the first and second tiers by an attachment device and (ii) each with an upper and a lower end, the lower end configured for securing the post to the ground and attaching the post to the first tier and the upper end configured for attaching the post to the second tier;

c. wherein the tiers and posts can be configured for use as a shade tent wherein the first tier comprises a shade tent floor and the second tier comprises a shade tent canopy positioned above the first tier and wherein (i) a bendable member is inserted into at least one of the plurality of perimeter sleeves, and (ii) a second tier support system is positioned below and proximal the second tier and comprises a first and a second cross brace, with each cross brace having a first and a second end, and a plurality of cross brace attachment members, wherein each cross brace end is attached to a cross brace attachment member attached to the upper end of one of the posts; and d. wherein one tier can be configured for use as a hammock, wherein (I) the tier comprises a hammock panel having a panel first end and a panel second end wherein the panel first end is attached to a first erecting structure and the panel second end is attached to a second erecting structure, and (ii) one or more of the panel perimeter apertures and one or more of the panel perimeter sleeves is proximal each panel end.

7. The convertible hammock-shade tent configurable as a shade tent and a hammock as claimed in claim 6 wherein at least one of the erecting structures of the hammock in the hammock configuration comprises one of the posts and a threaded shank is attached to the lower end of the post to secure the post to the ground.

* * * * *